US010064785B2

(12) United States Patent
Spallek et al.

(10) Patent No.: US 10,064,785 B2
(45) Date of Patent: Sep. 4, 2018

(54) PLASTIC CONTAINER PRODUCT

(71) Applicant: KOCHER-PLASTIK MASCHINENBAU GMBH, Sulzbach-Laufen (DE)

(72) Inventors: Michael Spallek, Ingelheim (DE); Johannes Geser, Gerlingen (DE); Martin Groh, Gaildorf (DE); Philipp Spreng, Neu-Ulm (DE)

(73) Assignee: KOCHER-PLASTIK MASCHINEBAU GMBH, Sulzbach-Laufen (DE)

( * ) Notice: Subject to any disclaimer, the term of this patent is extended or adjusted under 35 U.S.C. 154(b) by 0 days.

(21) Appl. No.: 15/571,538

(22) PCT Filed: Mar. 22, 2016

(86) PCT No.: PCT/EP2016/000497

§ 371 (c)(1),
(2) Date: Nov. 3, 2017

(87) PCT Pub. No.: WO2016/188598

PCT Pub. Date: Dec. 1, 2016

(65) Prior Publication Data

US 2018/0125755 A1 May 10, 2018

(30) Foreign Application Priority Data

May 22, 2015 (DE) ..... 10 2015 006 489

(51) Int. Cl.
*A61J 1/14* (2006.01)
*A61J 1/06* (2006.01)

(52) U.S. Cl.
CPC ..... *A61J 1/1406* (2013.01); *A61J 1/06* (2013.01); *A61J 1/1412* (2013.01); *A61J 1/1468* (2015.05)

(58) Field of Classification Search
CPC ..... A61J 1/1468; A61J 1/1412; A61J 1/06
See application file for complete search history.

(56) References Cited

U.S. PATENT DOCUMENTS

| | | | |
|---|---|---|---|
| 4,574,965 | A | 3/1986 | Meierhoefer |
| 5,868,721 | A | 2/1999 | Marinacci et al. |
| 2011/0240642 | A1 | 10/2011 | Zolcher |

FOREIGN PATENT DOCUMENTS

| | | |
|---|---|---|
| DE | 10 2004 051 300 | 1/2013 |
| EP | 0 364 783 | 4/1990 |
| JP | 11-348956 | 12/1999 |
| WO | 81/02286 | 8/1981 |

OTHER PUBLICATIONS

International Search Report (ISR) dated Jun. 14, 2016 in International PCT Application No. PCT/EP2016/000497.

*Primary Examiner* — Michael C Miggins
(74) *Attorney, Agent, or Firm* — Wenderoth, Lind & Ponack, L.L.P.

(57) ABSTRACT

The invention relates to a plastic container product, in particular produced by the blow-molding, filling, and sealing method, having a container wall which can be pierced by means of a cannula in predefinable areas for the purpose of access to the container content. Said plastic container product is characterized in that, in order to avoid punched parts which arise when the container wall is pierced with a cannula, the mathematical product of the container wall thickness in the piercing area and the tensile modulus of the plastic material to ISO 527 is less than 400 MPa·mm, in particular preferably less than 300 MPa·mm.

10 Claims, 5 Drawing Sheets

PLASTIC CONTAINER PRODUCT

Figure 1:
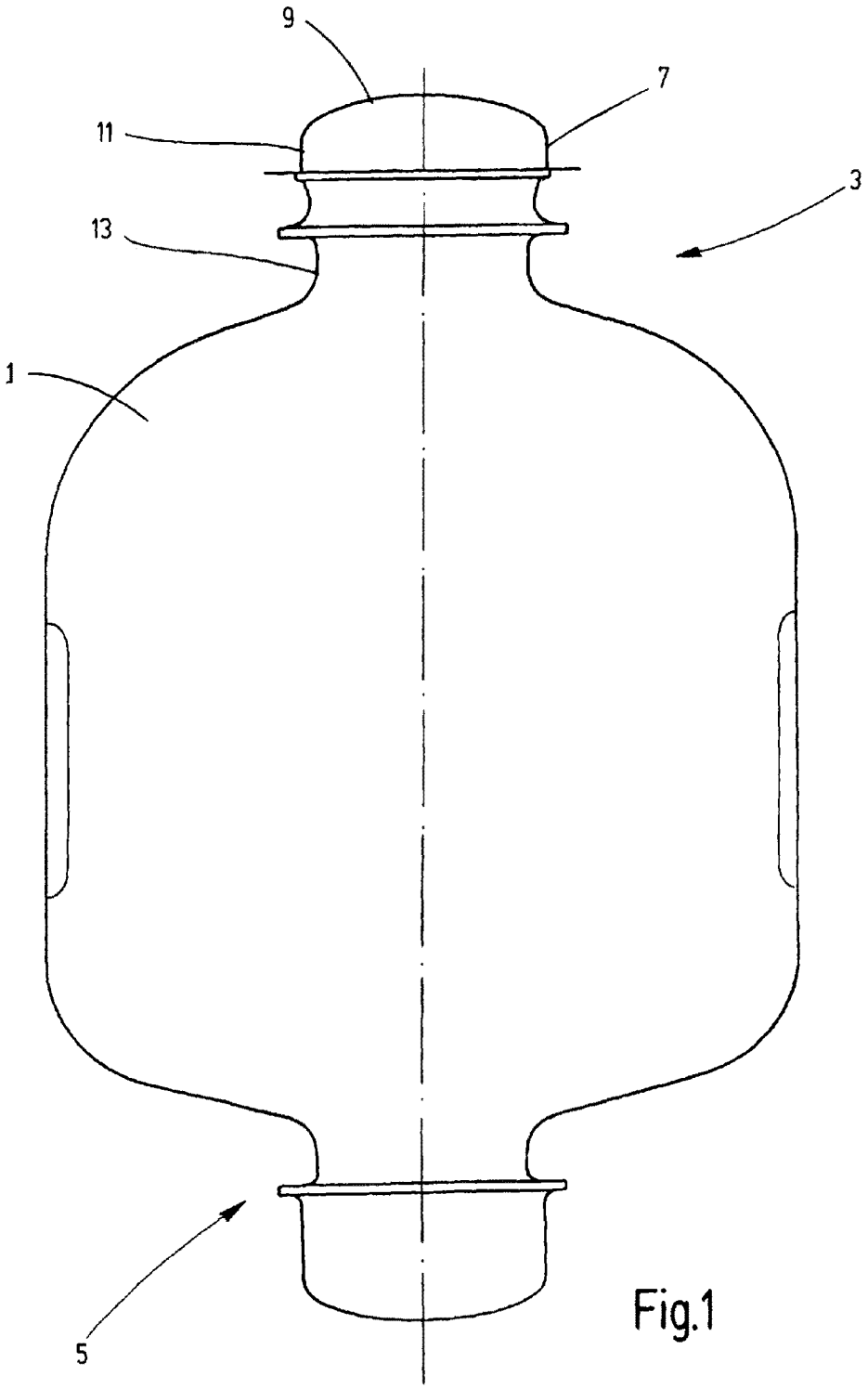

The invention relates to a plastic container product, in particular produced according to the blow-molding, filling and sealing process (BFS process), having a container wall which can be pierced by means of a cannula in predefinable regions for the purpose of extraction of the container contents.

When piercing plastic container products for medical purposes (pharmaceuticals, diagnostic products), such as for example injection vials, cylindrical ampoules or plastic containers for intravenous injections (DIN EN ISO 15747: 2012-07), with injection cannula, in particular as a component of collection syringes, particles can easily be "stamped out" of the closure material. The thus stamped out loose particles can remain in the cannula, the injection syringe, or in the container product itself. This can lead amongst other things to a blocking of the cannula, which makes it impossible to realize the injection operation, or particles can arrive in the infusion system with the filling material, which can significantly reduce the flow rate of the infusion.

In view of this problem, limit values for the use of injection vials with elastomer closures have accordingly already been proposed in EN ISO 8871-5:2014 and also in the US Pharmacopoeia, chapter 381.

To address this problem of particle contamination as a result of stamping out the plastic container product, which is also referred to as fragmentation in technical parlance, the prior art (U.S. Pat. No. 5,868,721) has already proposed special needle geometries, which nevertheless necessitate complex and expensive special cannulas.

A plastic container produced by means of injection molding having preferred, defined piercing positions for a plastic hollow spike, a collection needle or a collection cannula is known from WO 81/02286. The wall thickness must be very small at these piercing positions, and preferably less than 0.254 millimeters. Such very thin areas can in fact be advantageous when piercing and allow little particle-generating stamping waste production; nonetheless they present an essential drawback in that they can easily lead to leakage when, in the last stage of production of the filled and sealed container, the sterilization process, the high pressures and temperatures of an autoclave sterilization (121° C., 20 minutes) are applied. Furthermore, by contrast with injection molding processes according to WO 81/02286, in the context of blow-molding production processes, in particular in the context of blow-molding, filling and sealing processes, such small wall thicknesses can be reproducibly produced in large volumes only with great difficulty.

By contrast, U.S. Pat. No. 4,574,965 discloses a container product produced according to a blow-molding, filling and sealing process having a specially designed double dome geometry for the container head so as to thus guarantee reliable sealing and no particle formation when pierced with a metal cannula or plastic cannula for a process of extraction from the container. For this purpose it is necessary that a so-called slump or sag (dimple) forms in the head part material during piercing in the known solution. This is achieved only with so-called Low-Density Polyethylene (LDPE) materials, such as Rexen PE 107 or Eastman Chemical Tenite polyallomers, the temperature resistance of which is however far from sufficient for the conventional autoclave sterilization (121° C., 20 minutes) which means that reliable sterilization—as is typically required for infusion solutions and rinsing solutions—cannot be ensured. The required double dome geometry differs very significantly from the established head geometry of blow-molding, filling and sealing infusion containers as container products according to DIN EN ISO 15759:2006-05 and necessitates special cap systems, which do not conform to the established ISO standard 15759:2006-05, and this is in turn costly and can compromise the functional reliability of the entire container system.

Based on this prior art, the problem addressed by the invention is to provide a container product, which can in particular be produced according to the blow-molding, filling and sealing process and which can be autoclaved and for which the probability of the occurrence of stamped out particles and the quantity thereof on piercing of the plastic container wall is minimized. This problem is solved by a plastic container product having the features of Claim 1 in its entirety.

Because, according to the characterizing part of Claim 1, in order to prevent loose stamped parts, which are produced when the container wall is pierced with the cannula, the mathematical product consisting of the container wall thickness in the piercing region and the modulus of elasticity (tensile modulus according to ISO 527 at 50 mm/min) of the plastic material is less than 400 MPa·mm, particularly preferably less than 300 MPa·mm, in a surprising manner this ensures for an average person skilled in the art of injection collection technology that the probability of the occurrence and the potential quantity of stamped out loose particles on piercing of the container wall by means of a collection needle or a collection cannula is significantly minimized.

In a particularly advantageous manner, the above-mentioned problem is solved by means of integral container products, produced according to the known blow-molding, filling and sealing (BFS) process using polymers with high heat resistance, i.e. the melting temperature of the respective polymer is, in accordance with ISO 3146, at least 130° C. at an elongation of more than 12% (at 50 mm/min according to ISO 527). This is possible even with simple container head geometries according to ISO 15759:200605.

In a surprising manner, it has been demonstrated that a further reduction of the particle probability can be achieved in an inventive manner when, for the container product according to the invention, a cap is selected having an elastomer sealing element, which is pressed onto the container wall from the outside on or around the piercing region, a subarea of the container head surface, with a surface pressure of at least 20 N/cm$^2$, at least during the piercing operation itself.

This cannot be reliably achieved with caps known per se, as described for example in the document US 2011/240642 A1 and in the document DE 10 2004 051 300 C5.

Said elastomer sealing element can for example be formed from a thermoplastic elastomer, a polyisoprene, a silicone or a halobutyl rubber.

Additional advantageous embodiments are the subject of the other dependent claims.

Figure 2:
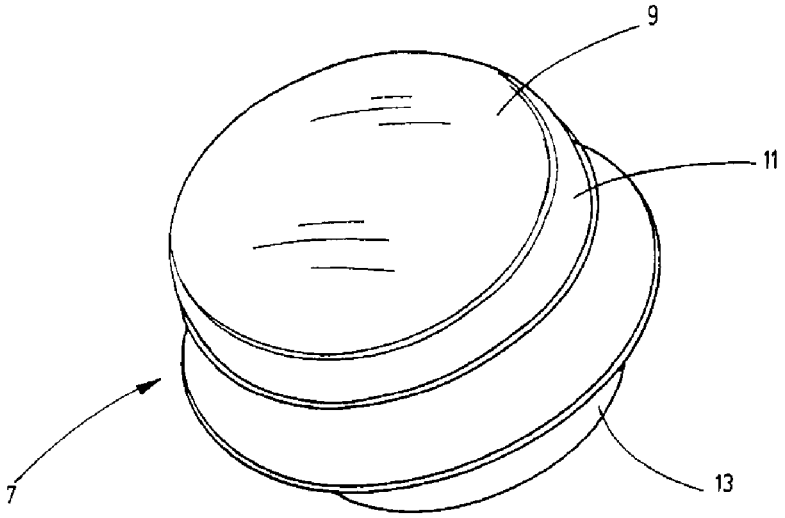
Figure 3:
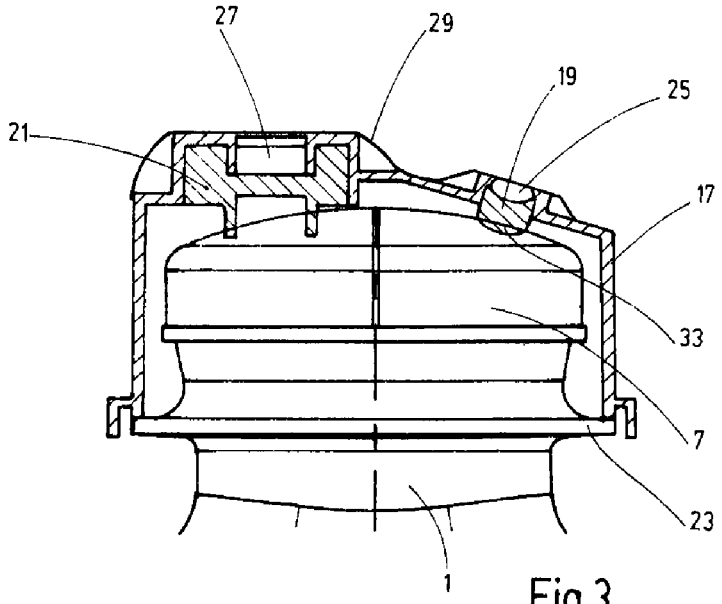
Figure 4:
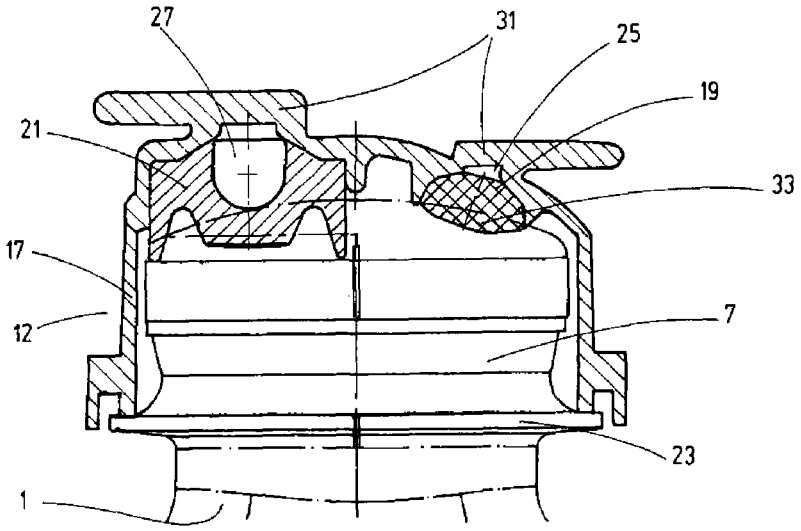
Figure 5:
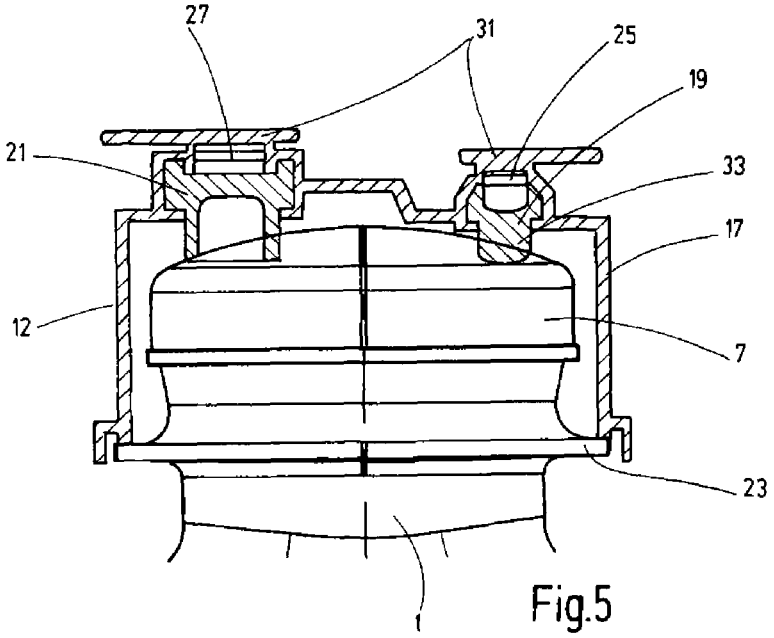

The solution according to the invention is explained in detail below with reference to a container product together with cap designs according to the invention for such a container. The drawings show, in schematic and not to scale depictions, FIG. 1 a front view, which is depicted slightly magnified compared with a practical embodiment, of a container in the form of an infusion bottle with two access points arranged opposite one another, of which the one depicted at the top in the figure is provided with a head part in accordance with the prior art according to DIN ISO 15759;

FIG. 2 a perspective oblique view, which is depicted approximately double the size of a practical embodiment, of an exemplary embodiment of a head part of the container according to FIG. 1;

FIGS. 3 to 5 different cap designs according to the invention, in each case in the form of a longitudinal section, which are welded from above onto the head part of the container.

Figure 6:
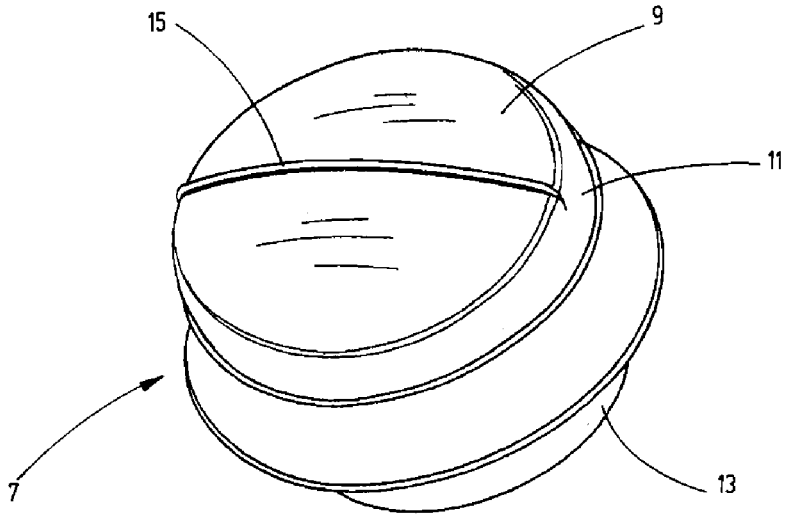
Figure 7:
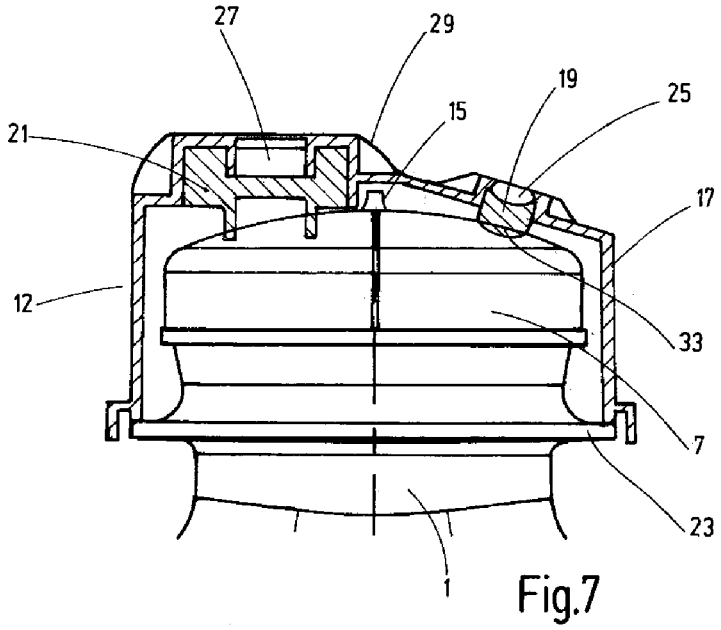
Figure 8:
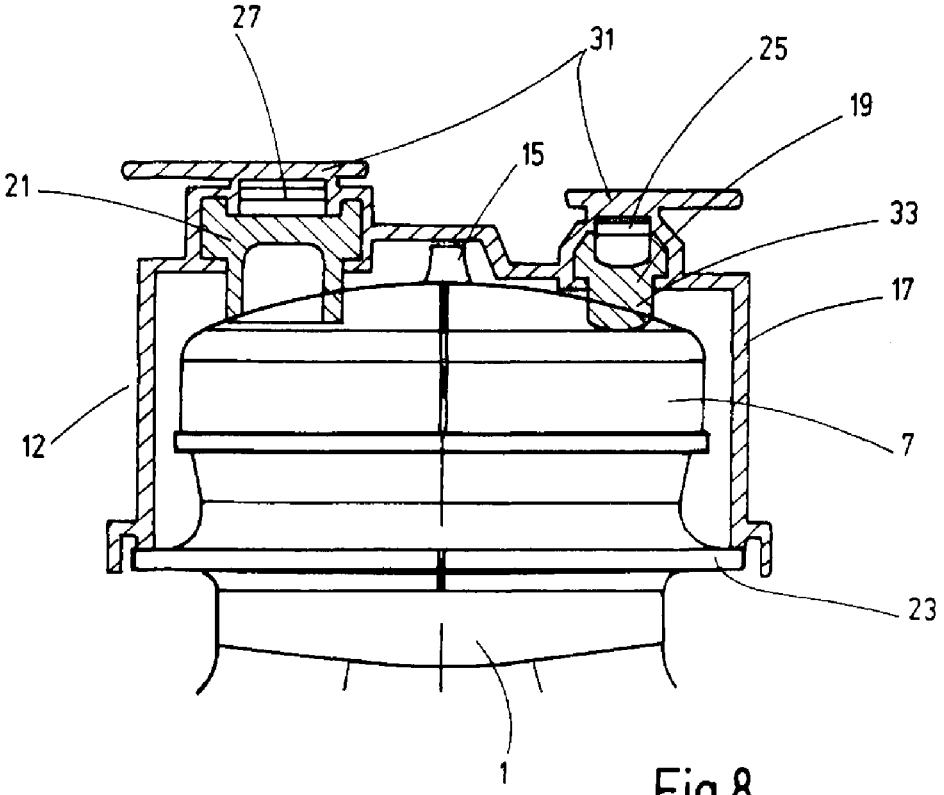

FIG. 6 a perspective oblique view, which is depicted approximately double the size of a practical embodiment, of an additional exemplary embodiment of a head part of the container according to FIG. 1;

FIGS. 7 to 8 different cap designs according to the invention, in each case in the form of a longitudinal section, which are welded from above onto the head part of the container according to FIG. 6.

FIG. 1 shows an integral container, produced according to a blow-molding, filling and sealing operation, in the form of an infusion bottle 1 as a container product having a top access point 3 and a bottom access point 5. The container product 1 is produced from a plastic material, in particular a polyolefin material. The container product 1 has an integral head part 7 at the access point 3 lying at the top in FIG. 1. The head part 7 which is formed in the depicted example according to the prior art in accordance with DIN ISO 15759:2006-05 can be connected to individual caps according to the invention in accordance with the depictions of FIGS. 3 to 5, for example by means of welding, overmolding or sealing, in the region of the top access point 3 of the filled and sealed infusion bottle 1. A continuously extending head surface 9 or head part top side 9 is provided at the front-side end of the head part 7 for extraction and/or addition operations, which, in the form of a head membrane which can be penetrated by means of a cannula or a piercing spike, spans a transition region 11, at which the head part 7 transitions into the neck part 13 of the container product 1. The head surface 9 formed by this head membrane spans the transition region 11 with a uniformly convex curvature according to the depiction of FIGS. 1 and 2.

The infusion bottle 1 as a container product which is depicted in FIG. 1 can be produced with the aid of a Bottelpack system of the type bp 364 manufactured by the company Rommelag with an exemplary container size of 500 ml using the blow-molding, filling and sealing process, and said infusion bottle has the above-mentioned head form. The container which was in this respect produced in an integral manner was produced using polyolefins with high heat resistance, i.e. a melting temperature according to ISO 3146 of at least 130° C. and a melt flow rate (MFR230° C./2.16 kg according to ISO 1133) of less than 3 g/10 min. In order to reduce the risk of particle formation or of fragmentation, according to the invention a polymer with an elongation of preferably more than 12% (at 50 mm/min according to ISO 527-1/-2) was selected and for the product the container wall thickness in millimeters in the piercing region and the modulus of elasticity (tensile modulus at 50 mm/min according to ISO 527) of the container polymer are selected, at least at this point, such that the mathematical product (hereafter also referred to as the fragmentation characteristic value) is less than 400 MPa·mm, preferably less than 300 MPa·mm, while the wall thickness in the piercing region should however be at least 0.3 mm.

A further reduction in the probability of fragmentation can be obtained in the case of selection for the container product according to the invention of a cap according to FIGS. 3 to 5 with a cap housing 17, the respective elastomer sealing element 19, 21 of which, consisting of standard elastomer materials, is pressed onto the container wall on or around the piercing region 33 with a surface pressure of at least 20 $N/cm^2$ at least when the container wall is pierced with a cannula. After the closing of the head part 7 with formation of the closed head surface 9, the respective assignable cap housing 17 is mounted in a tight manner on the depicted head parts 7 according to FIGS. 3 to 5. An autoclaving then takes place at 121° C. for a period of 20 minutes.

The respective cap housing 17 is, according to the depictions of FIGS. 3 to 5, circumferentially connected in a tight manner to a circumferentially projecting collar 23 of the container head part 7 of the BFS container 1 (not depicted in full in FIGS. 3 to 5). The cap housing 17 has two access points 25 and 27 at its top side, which are respectively sealed in a microbiologically tight manner by an easily removable tamper-evident closure in the form of sealing foil 29 (FIG. 3) or in the form of detachable tabs 31 (cf. FIGS. 4 and 5). Said access points 25 and 27 serve for piercing with a cannula, and to this extent a cannula access point 25 is realized, with the other access point as a hollow spike access point 27 serving for piercing with a piercing part in the form of a hollow spike, for example a transfusion device according to EN ISO 1135-4. Located beneath the depicted tamper-evident closures 29, 31 are the above-mentioned respective elastomer sealing elements 19 or 21, which are made directly from an elastomer material and which extend between the inner side of the cap housing 17 and the head surface 9 of the infusion container 1.

The invention provides that at least the elastomer sealing element 19 of the cannula access point 25 is formed such that it is pushed or pressed with a minimum pressure in a firm manner onto a subarea of the container head 7, in other words, the piercing surface area, or simply the piercing region 33. The surface pressure of the elastomer element 19 on the piercing region 33 can be determined in a constructive manner by means of the cross-sectional area and the Shore hardness of the elastomer element 19 and by means of the height of the cap housing 17. Furthermore, material- and/or form changes resulting from the conventionally required autoclaving process at 121° C. and with a 20 minute process time must be considered from a constructive perspective. A sagging of the piercing surface area 33 of 2 to 6 mm can thus occur in particular in the case of containers with a fragmentation characteristic value of less than 300 MPa·mm. In order to guarantee the surface pressure required according to the invention on the piercing region 33, it is optionally possible to advantageously use a bar-like reinforcement, for example in the form of a reinforcing rib 15, as depicted in FIG. 6 and as described in PCT/EP 2014/002076.

FIG. 6 shows the head surface 9 with a reinforcing rib 15 extending over it, with the convex curvature of said reinforcing rib following the convex curvature of the head surface 9. The reinforcing rib 15 forms a distinctly projecting bar, which spans the head surface 9 lying diametrically therein. This bar-like rib 15 permits the reliable application of the surface pressure needed to reduce the fragmentation in that it increases the resistance against the bending of the curvature of the head surface 9 towards the inside of the container, and this can be further increased by the creation of a firm connection with the cap, for example by means of welding or adhesion.

In embodiments of the head surface 9 according to FIG. 6, caps according to FIG. 3 and FIG. 4 can be used as is depicted in FIGS. 7 and 8.

The preferred size of the piercing region 33 is from 1 $mm^2$ to 70 $mm^2$, particularly preferably from 20 $mm^2$ to 50 $mm^2$. The preferred Shore hardness of the elastomer sealing element 19 is from 20 to 65 Shore A, particularly preferably from 25 to 50 Shore A. The surface pressure should be more than 20 $N/cm^2$, in order to thus allow the fragmentation risk to be significantly reduced.

With the container products with the fitted caps according to the designs of FIGS. 3 and 5 and with caps without surface pressure, fragmentation tests were carried out in a manner similar to that described in ISO 15759:2005 or in US Pharmacopoeia, chapter 381 "Fragmentation" and in each case the quantity of fragments from the container material with 48 punctures with steel cannulas according to ISO 7864 and an external diameter of 0.8 mm was determined. The limit value for fragmentation is 5 fragments according to US Pharmacopoeia, chapter 381 "Fragmentation".

As container polymers, the following 8 different materials B1, B2, LB1, LB2, T1, M1, M2 and M3 were used.

B1 is a PP copolymer of the type Bormed SB815MO from the company Borealis with a modulus of elasticity (tensile modulus according to ISO 527 at 50 mm/min) of 475 MPa.

LB1 is a polypropylene of the type Purell SM 170G from the company LyondellBasell with a modulus of elasticity of 650 MPa.

B2 is a polypropylene of the type Bormed RB845MO from the company Borealis with a modulus of elasticity of 1000 MPa.

LB2 is a modified random copolymer of the type Purell RP270G from the company Lyondell Basell with a modulus of elasticity of 950 MPa.

T1 is a polypropylene of the type PPM R021 specifically for medical applications from the company Total with a modulus of elasticity of 1000 MPa.

M1 is a blend with a modulus of elasticity of ca. 730 MPa produced from 75% of the LB2 material with 25% Vistamaxx™ 3020, a PP-based elastomer from the company Exxon.

M2 is a blend with a modulus of elasticity of ca. 680 MPa produced in a similar manner to M1 but with a 30% Vistamaxx™ 3020 content.

M3 is a blend with a modulus of elasticity of ca. 640 MPa produced in a similar manner to M1 but with a 35% Vistamaxx™ 3020 content.

The addition of functional master batches such as Vistamaxx permits the modification of the mechanical properties. Different materials are also included, of the kind which have become known under the trade names Dow Versify or Melitek meliflex XC Polymer+, etc., with the chemical compatibility for pharmaceutical products needing to be considered.

The results are summarized in the following table in which they are ordered according to increasing fragmentation characteristic value. They show that from a fragmentation characteristic value of less than 400 MPa·mm the fragmentation behavior is significantly improved, and it can be further improved in a surprising manner by means of a cap according to the invention.

| Test No. | container material | average wall thickness piercing region in mm | Fragmentation characteristic value modul. of elas. × wall thickness in MPa * mm | with cap without surface pressure quantity of fragments | with cap according to the invention FIG. 3 quantity of fragments | with cap according to the invention FIG. 5 quantity of fragments |
|---|---|---|---|---|---|---|
| 1 | B1 | 0.3 | 143 | 2 | 1 | 1 |
| 2 | B1 | 0.41 | 195 | 1 | 0 | 1 |
| 3 | LB1 | 0.33 | 215 | 1 | 0 | 0 |
| 4 | M3 | 0.34 | 218 | 1 | 0 | 0 |
| 5 | M2 | 0.33 | 224 | 1 | 1 | 0 |
| 6 | M1 | 0.32 | 234 | 2 | 0 | 2 |
| 7 | B1 | 0.53 | 252 | 4 | 1 | 2 |
| 8 | LB1 | 0.39 | 254 | 2 | 2 | 1 |
| 9 | M3 | 0.45 | 288 | 2 | 0 | 1 |
| 10 | B1 | 0.61 | 290 | 4 | 3 | 2 |
| 11 | M1 | 0.4 | 292 | 3 | 0 | 2 |
| 12 | M2 | 0.45 | 306 | 3 | 2 | 2 |
| 13 | B1 | 0.67 | 318 | 4 | 4 | 4 |
| 14 | B2 | 0.32 | 320 | 3 | 3 | 2 |
| 15 | LB2 | 0.34 | 323 | 2 | 2 | 1 |
| 16 | T1 | 0.33 | 330 | 4 | 2 | 1 |
| 17 | LB1 | 0.52 | 338 | 3 | 2 | 2 |
| 18 | M3 | 0.55 | 352 | 3 | 2 | 0 |
| 19 | M2 | 0.52 | 354 | 3 | 1 | 1 |
| 20 | B1 | 0.75 | 356 | 4 | 3 | 3 |
| 21 | M3 | 0.58 | 371 | 3 | 2 | 2 |
| 22 | M1 | 0.52 | 380 | 4 | 3 | 1 |
| 23 | LB2 | 0.4 | 380 | 3 | 2 | 3 |
| 24 | LB1 | 0.59 | 384 | 4 | 2 | 3 |
| 25 | T1 | 0.38 | 380 | 3 | 1 | 3 |
| 26 | B1 | 0.87 | 413 | 6 | 4 | 4 |
| 27 | B2 | 0.42 | 420 | 5 | 3 | 4 |
| 28 | M2 | 0.62 | 422 | 5 | 3 | 2 |
| 29 | M3 | 0.72 | 461 | 6 | 5 | 4 |
| 30 | M1 | 0.64 | 467 | 6 | 5 | 4 |
| 31 | M2 | 0.69 | 469 | 7 | 4 | 5 |
| 32 | B2 | 0.48 | 480 | 5 | 5 | 5 |
| 33 | LB1 | 0.74 | 481 | 6 | 5 | 5 |
| 34 | LB2 | 0.53 | 504 | 7 | 5 | 4 |
| 35 | M1 | 0.69 | 504 | 6 | 6 | 6 |
| 36 | T1 | 0.52 | 520 | 6 | 5 | 5 |
| 37 | LB2 | 0.58 | 551 | 6 | 5 | 6 |

-continued

| Test No. | container material | average wall thickness piercing region in mm | Fragmentation characteristic value modul. of elas. × wall thickness in MPa * mm | with cap without surface pressure quantity of fragments | with cap according to the invention FIG. 3 quantity of fragments | with cap according to the invention FIG. 5 quantity of fragments |
|---|---|---|---|---|---|---|
| 38 | LB1 | 0.85 | 553 | 7 | 6 | 6 |
| 39 | T1 | 0.62 | 620 | 8 | 6 | 6 |
| 40 | B2 | 0.64 | 640 | 7 | 7 | 6 |
| 41 | LB2 | 0.72 | 684 | 6 | 5 | 5 |
| 42 | T1 | 0.69 | 690 | 10 | 5 | 6 |
| 43 | B2 | 0.75 | 750 | 10 | 8 | 9 |

The invention described above makes it possible for a container which is produced according to the BSF process and which is autoclavable to be designed in such a way that, both with the cap and without the cap, the probability and quantity of stamped out particles upon piercing of the container wall of the container is minimal. There is no equivalent of this solution in the prior art.

The invention claimed is:

1. A plastic container product, in particular produced according to the blow-molding, filling and sealing process, having a container wall which can be pierced by means of a cannula in predefinable regions for the purpose of accessing the container contents, characterized in that, in order to prevent stamped parts, which are produced when the container wall is pierced with the cannula, the mathematical product of the container wall thickness in the piercing region (33) and the tensile modulus according to ISO 527 of the plastic material is less than 400 MPa·mm, particularly preferably less than 300 MPa·mm.

2. The container product according to claim 1, characterized in that, as the plastic material, at least one polymer is used with a high heat resistance, in particular with a melting temperature according to ISO 3146 of at least 130° C., and an average elongation according to ISO 527 of more than 12%.

3. The container product according to claim 1, characterized in that, as the plastic material, a polypropylene, a polypropylene copolymer or a blend with PP-based elastomers is used for the production thereof.

4. The container product according to claim 1, characterized in that the head part (7) of the container is covered with a cap (12), which is firmly connected to the head part (7).

5. The container product according to claim 1, characterized in that at least one pierceable insert (19), preferably formed from elastomer material, is provided between the cap (12) and the head part top side (9) of the container so that, at least during the piercing, said insert presses on the head part top side (9) with a surface pressure of preferably more than 20 N/cm2.

6. The container product according to claim 1, characterized in that at least two pierceable inserts (19, 21) which are different from one another are provided, with said inserts serving different purposes, the one (19) serving for piercing by means of a cannula, and the other (21) serving for piercing by means of a hollow spike.

7. The container product according to claim 1, characterized in that the hardness of at least one elastomer insert (19) is from 20 to 70 Shore A, particularly preferably from 25 to 50 Shore A.

8. The container product according to claim 1, characterized in that the piercing region (33) on the head part top side (9) is from 1 to 70 mm2, particularly preferably from 20 to 50 mm2 and the wall thickness of the container region to be pierced is at least 0.3 mm.

9. The container product according to claim 1, characterized in that the head part (7) of the container (1) has a reinforcing rib (15).

10. The container product according to claim 1, characterized in that the head part (7) of the container (1) has a reinforcing rib (15) and is firmly connected to the cap housing (17).

* * * * *